US005078036A

United States Patent [19]

Ray

[11] Patent Number: 5,078,036

[45] Date of Patent: Jan. 7, 1992

[54] SLICING OF BLOCKS OF TOBACCO CASES, BALES OR HOGSHEADS

[75] Inventor: Eric T. Ray, Salisbury, England

[73] Assignee: GBE International PLC, Andover, England

[21] Appl. No.: 457,716

[22] PCT Filed: May 23, 1989

[86] PCT No.: PCT/GB89/00570

§ 371 Date: Mar. 23, 1990

§ 102(e) Date: Mar. 23, 1990

[87] PCT Pub. No.: WO89/11229

PCT Pub. Date: Nov. 30, 1989

[30] Foreign Application Priority Data

May 25, 1988 [GB] United Kingdom ..... 8812389

[51] Int. Cl.[5] ..... A24B 3/06; B26D 5/12

[52] U.S. Cl. ..... 83/870; 83/639.1; 83/697; 83/931; 29/239

[58] Field of Search ..... 83/870, 639.1, 613, 83/636, 697, 931; 131/117, 118; 29/239, 426.4

[56] References Cited

U.S. PATENT DOCUMENTS 2,771,107 11/1956 Vasey ..... 83/870
3,364,556 1/1968 Cocce et al. ..... 83/697 X
4,554,933 11/1985 Neville ..... 131/304
4,628,948 12/1986 Beard et al. ..... 131/327

FOREIGN PATENT DOCUMENTS 0143585 6/1985 European Pat. Off. .
1068599 11/1959 Fed. Rep. of Germany .

*Primary Examiner*—Frank T. Yost
*Assistant Examiner*—Eugenia A. Jones
*Attorney, Agent, or Firm*—Dowell & Dowell

[57] ABSTRACT

The invention provides an apparatus for cutting or paring a slice of material from a block (17) of material which has a lamina or strata structure, comprising a reciprocable blade (11) having a cutting edge (20, 21) arranged to enter and traverse the block of material to remove a slice therefrom during a forward or cutting stroke of the blade, in which means is provided to move the cutting edge of the blade in a direction having a component transverse to the direction of reciprocation of the blade after the blade has penetrated a short distance into the block thus to pare the slice from the remainder of the block substantially following the path of a boundary between lamina or strata in the block. In a preferred form the blade is wider than the slice to be cut and is formed with inclined portions 11*c*, 11*d*) at its leading or cutting edge, which portions are arranged so that the cutting edge of the blade is in the form of wide angled "V".

11 Claims, 2 Drawing Sheets

SLICING OF BLOCKS OF TOBACCO CASES, BALES OR HOGSHEADS

BACKGROUND OF THE INVENTION

1. Field of the Invention

This invention concerns opening of blocks of tobacco which have been packed in cases, bales or hogsheads. Such blocks have laminations or strata and successive layers or slices taken along such strata are removed and are then fed to a conditioning process. (There is an alternative procedure in which slices are taken at right angles to the strata, which does not concern this invention.). In particular the invention thus concerns the means and method for dividing off the slices parallel with the strata.

2. History of the Related Art

Patent applications EPO 0095866 and EPO 0159836 disclose examples of prior art in this field.

When dividing a slice from the package it is desirable to divide it at a boundary between natural strata in the package to obtain a clean division. In practice these strata are not flat planes, but are generally convex due to the way the block has been formed (or concave if the block has been inverted). In some cases the strata can be sloping if the filling of a case containing the block is biased to one side or one end.

Existing systems for separating such slices typically use a two pronged fork (as fitted to a fork lift truck), which is forced into the block. Because these prongs are rigid, blunt ended and moving on a fixed path they tend to cut or tear through the laminations, degrading the leaves in the lamina. And then when the slice is separated from the main package there is an untidy cleavage of interlocking lamina, which hang below the prongs.

It is very difficult to make a prong or blade which is sufficiently compliant to follow the contour of a strata in all three dimensions, and if two or more prongs are used, it is also difficult in practice to enter these between the same strata.

SUMMARY OF THE INVENTION

It is an object of the present invention to provide an improved apparatus and method for separating such slices from such a block of tobacco.

Any blade or prong has thickness and part of the action of dividing is one of wedging or prising apart. If a wedge shaped prong or spade is inserted into the edge of a case the case starts to split apart along a natural cleavage.

According to the present invention there is provided an apparatus for separating a slice of material from a block of said material which has a laminated structure, comprising a) a reciprocable blade having a leading cutting edge arranged to penetrate the block of material to remove a slice therefrom during a forward separating stroke of the blade in the general direction of the planes of the laminations, b) a carriage having said blade mounted thereon to extend in a direction of the forward stroke, c) drive means to effect reciprocation of said carriage, d) pivot means connecting the trailing end of said carriage to said drive means to permit tilting of said carriage relative to said drive means, e) guide means along which said carriage reciprocates, said guide means including inclined cam portions arranged therealong at a predetermined position, which inclined cam portions serve to join two portions of said guide means disposed at different levels, and f) cam follower means on said carriage which engage said inclined cam portions after said predetermined position has been reached to cause said carriage to tilt so that the cutting edge of the blade effects a movement transverse to the direction of reciprocation of said carriage whereby after the blade has penetrated a short distance into the block the blade pares the slice from the remainder of the block by substantially following the path of a boundary between laminations in the block.

By this means the blade is lifted a small amount away from the main body of the block whereby the split is propagated forward ahead of the blade and to both sides along a natural cleavage surface between the lamina or strata.

If after initial penetration the blade is inserted further into the block the force required will be less and the split will precede ahead of the blade without the blade cutting into any convexity of the cleavage surface, provided of course that the lift exceeds the convexity.

If two blades are used, as in the prior art, it is unlikely that they will enter between the same strata or cleavage surface, so it is preferably to use a single blade which produces a forward and sideways wedging action as the blade is inserted. It is also desirable to have a continuous blade to give a complete separation of the lamina and to provide a surface over which the slice can be slid onto a receiving platform without damage.

BRIEF DESCRIPTION OF THE DRAWINGS

In order to promote a fuller understanding of the above and other aspects of the present invention an embodiment will now be described by way of example only with reference to the accompanying drawings in which.

DESCRIPTION OF THE PREFERRED EMBODIMENT

Figure 1:
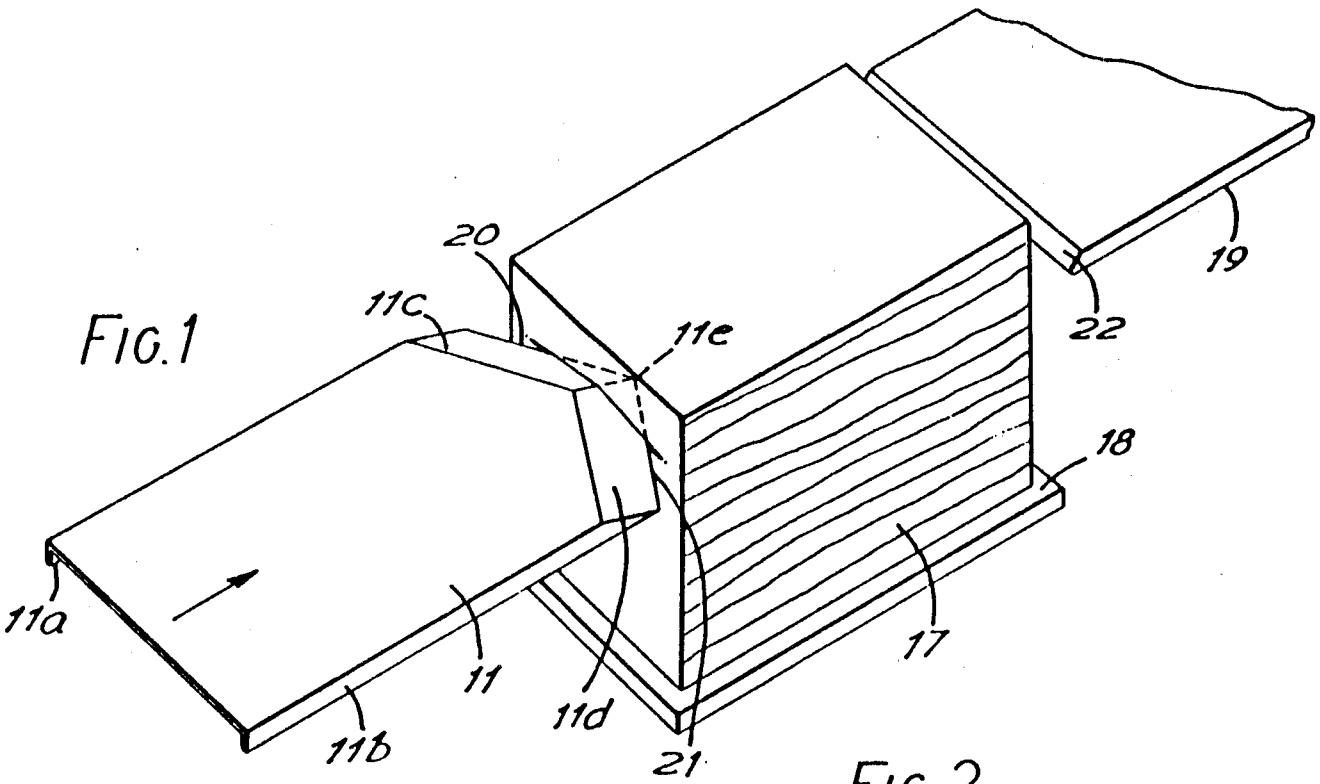
FIG. 1 is a schematic perspective view of a case of tobacco and a slicing blade.
Figure 2:
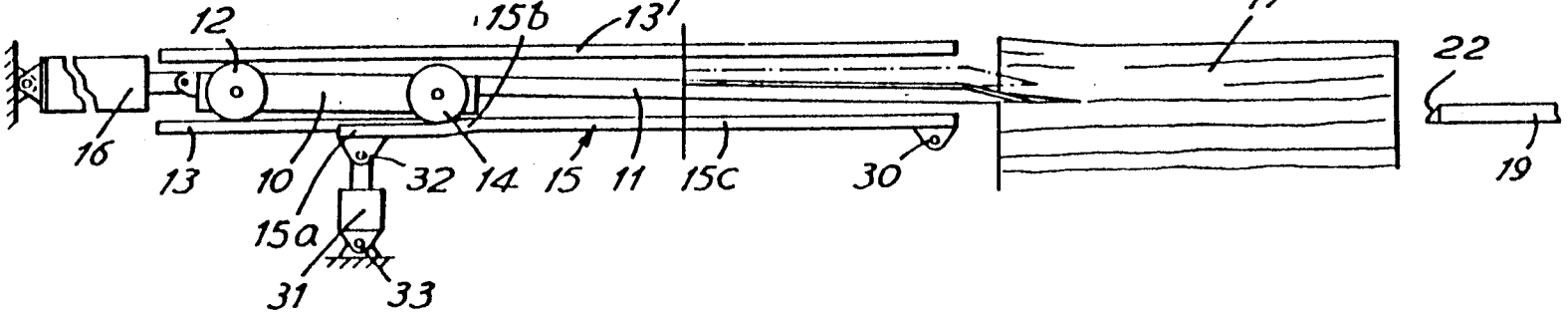
FIG. 2 is a schematic side elevation of an embodiment of the invention showing a blade mounted for movement along tracks.

In FIG. 2 a carriage 10 has mounted thereon at its forward end a blade 11. The carriage is provided with rear rollers 12 which run on a horizontally disposed first pair of spaced rails 13, and is provided with front rollers 14 which run on a further pair of spaced rails 15, the latter each comprising two horizontal portions 15*a*, 15*c*, joined by an inclined or cam portion 15*b*.

A pair of upper rails 13' prevents the rear wheels from lifting and may, if desired, overlap the front rollers as well to limit the lift of the front wheels.

The blade 11 is of hollow inverted channel-like construction like an inverted tray, made from 3 to 5 mm thick plate, to provide clearance for very convex surfaces. It is formed with side walls 11*a* and 11*b* and has two inclined symmetrically arranged inclined surfaces 11*c* and 11*d* at the leading or cutting edge, said inclined surfaces being also angled back from the leading or cutting tip 11*e*.

The carriage is arranged to be reciprocated by means of a pneumatic cylinder 16 so as to drive the blade between lamina of a block of tobacco as indicated at 17 supported on a platform 18, the latter being successively raised (by known mechanism described below) as slices are removed and deposited by the blade 11, on a fixed platform 19. The line of application of force on the blade 11 is on or above the leading edge of the blade, so that there is a small moment which in addition to gravity maintains the front rollers 14 on the lower rails 15. The leading edge of the platform 19 is preferably bevelled as indicated at 22, to provide a lead edge for the blade 11 should it be low enough to strike the platform.

The inclined surfaces 11*c* and 11*d* of the blade 11 have respective sharp edges 20, 21 set at typically 120 degrees to each other and meeting at the tip 11*e*. The inclined surfaces 11*c* and 11*d* form a bevel typically at between 10 degrees and 20 degrees to the horizontal which continues back to the main surface of the blade so as to form a blade having side walls 11*a* and 11*b* typically 25 to 50 mm deep.

The sharp edges 20, 21 are for the initial insertion of the blade into the block and the bevel angle, typically of about 15 degrees, is to provide a wedge or lifting ramp for subsequent splitting rather than cutting of a slice from the block.

It is preferable that the blade starts its stroke by being declined and that, after an initial entry of typically 50 to 300 mm, the leading edge is raised typically 25 to 30 mm to bring the blade into a horizontal position. The two front wheels 14 have a slightly wider track than the rear wheels and the further pair of rails 15 are positioned outside and adjacent to the first pair 13. The pair of rails 15 are at about the same level as the first pair 13 over the portions 15*c* but start at a lower level over portions 15*a* with the inclined portions 15*b* forming an incline or cam surface up to the portions 15*c* at the same level as rails 13 (see FIG. 2).

The first portion 15*a* and the cam portion 15*c* of the pair of rails 15 may be shaped to achieve different characteristics of initial penetration and then lift of the leading edge of the blade into the block.

Figure 3:
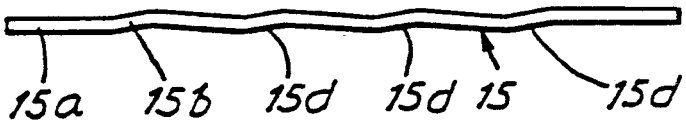
FIG. 3 shows schematically an alternative form of rail profile for use in the embodiment of FIG. 2.

With some cases it is more difficult to prise apart the slices. Accordingly, in an alternative arrangement of the device of FIG. 2, the rails 15 (see FIG. 3) are shaped so that the initial lift cam surface 15*b* is followed by a gradual lowering and then a further lift cam surface 15*d*, which can be repeated several times through the travel of the blade. This action simulates the manual action which would be used if one was prising a slice from the block with a spade.

In the alternative arrangement of the rails 15 with successive rises and falls, if the fall is limited by the tobacco then the front wheels 14 may lift off the rails taking up the clearance between them and the upper rails 13, and the blade may ride over the obstruction without cutting through it.

Figure 4:
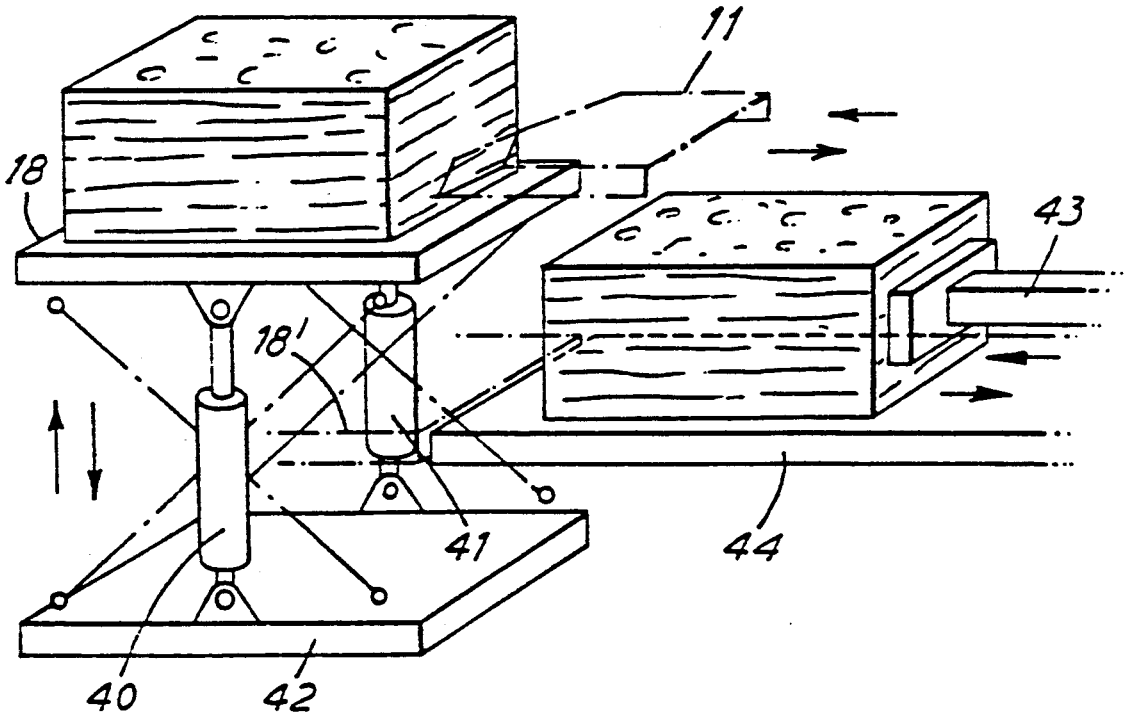
FIG. 4 is an arrangement of a platform for raising the block of tobacco during slicing by the arrangement of FIG. 2.

FIG. 4 shows an arrangement in which the platform 18 may be raised to a desired position by an hydraulic cylinder 40 controlled by a position transducer 41 connected between the platform 18 and a base member 42.

After slicing of an entire block has taken place the platform is lowered automatically to position on the platform 18 whereby a fresh block is moved by a pusher 43 from a fixed delivery platform 44.

Slicing takes place at a level above the height of the delivery platform 44.

In a further modification of the arrangement shown in FIG. 2, the further pair of rails 15 may be pivotally mounted at their front ends as indicated at 30; and supported at their rear ends by means of a fluid pressure operated piston and cylinder device 31, the piston rod of which is pivotally connected to the rails 15 at a pivot axis 32 and the cylinder of which is pivotally mounted on a base of the machine at 33.

With this arrangement, when the blade 11 has completed its forward cutting stroke, before the blade is returned for a subsequent cutting stroke, the device 31 is operated to raise that end of the rails 15. This has the effect of lifting the cutting edges 20, 21 so that when the blade is drawn back, they do not touch the top surface of the block thus avoiding damage to the surface.

When the blade 11 has completed its return stroke, the device 31 is again operated to lower the rails 15 back to their original position for a fresh slice cutting stroke of the blade.

In some cases, the rails 15 may be supported on a piston and cylinder device at both ends to achieve the same purpose of raising and lowering the rails.

While the invention has been described with reference to specific embodiments, modifications and variations of the invention may be constructed without departing from the scope of the invention, which is described in the following claims.

I claim:

1. An apparatus for separating a slice of material from a block of said material which has a laminated structure, comprising a) a reciprocable blade having a leading cutting edge arranged to penetrate the block of material to remove a slice therefrom during a forward separating stroke of the blade in the general direction of the planes of the laminations, b) a carriage having said blade mounted thereon to extend in a direction of the forward stroke, c) drive means to effect reciprocation of said carraige, d) pivot means connecting the trailing end of said carriage to said drive means to permit tilting of said carriage relative to said drive means, e) guide means along which said carriage reciprocates, said guide means including inclined cam portions arranged therealong at a predetermined position, which inclined cam portions serve to join two portions of said guide means disposed at different levels, and f) cam follower means on said carriage which engage said inclined cam portions after said predetermined position has been reached to cause said carriage to tilt so that the cutting edge of the blade effects a movement transverse to the direction of reciprocation of said carriage whereby after the blade has penetrated a short distance into the block the blade pares the slice from the remainder of the block by substantially following the path of a boundary between laminations in the block.

2. An apparatus according to claim 1, wherein said guide means comprises a first pair of rails engaged by a first part of said cam follower means to guide the trailing end of said carriage during reciprocation, and a second pair of rails disposed laterally of said first pair of rails and engaged by a second part of said cam follower means to guide the leading end of said carriage during reciprocation.

3. An apparatus according to claim 2, wherein said first and second parts of said cam follower means comprise pairs of rollers respectively.

4. An apparatus according to claim 3, wherein said second pair of rails has a series of such inclined cam portions arranged to cause the cutting edge of the blade to reciprocate in said transverse direction during the forward stroke of the blade.

5. An apparatus according to claim 3, wherein said second pair of rails are pivotally mounted at their front ends and supported at their rear ends, means being provided for raising the rear ends at the end of the forward stroke of the blade to lift the cutting edge clear of the block during the return stroke of the blade.

6. An apparatus according to claim 5, wherein said means for raising the rear ends of the second pair of rails comprises a fluid pressure operated piston and cylinder device.

7. An apparatus according to claim 3, wherein a third pair of rails is provided at a level above said first and second pairs of rails to engage both said pairs of rollers and retain the latter on their respective pairs of rails.

8. An apparatus according to claim 1, wherein said drive means comprises a fluid pressure operated piston and cylinder device.

9. An apparatus according to claim 1, wherein said blade is formed with a leading end formed with inclined portions to give a wedge action as the blade penetrates the block to assist in paring the slice from the block.

10. An apparatus according to claim 9, wherein said inclined portions are arranged so that the cutting edge of the blade is in the form of a wide angled "V".

11. An apparatus according to claim 1, including vertically movable support means to support said material, and a fluid pressure operated piston and cylinder device for relocating said material after each slice has been removed.

* * * * *